US011105026B2

(12) United States Patent
Yoshida et al.

(10) Patent No.: US 11,105,026 B2
(45) Date of Patent: Aug. 31, 2021

(54) WARP-KNITTED FABRIC

(71) Applicant: Asahi Kasei Kabushiki Kaisha, Tokyo (JP)

(72) Inventors: Yuji Yoshida, Tokyo (JP); Norito Kashima, Tokyo (JP)

(73) Assignee: Asahi Kasei Kabushiki Kaisha, Tokyo (JP)

( * ) Notice: Subject to any disclaimer, the term of this patent is extended or adjusted under 35 U.S.C. 154(b) by 43 days.

(21) Appl. No.: 16/337,859

(22) PCT Filed: Oct. 3, 2017

(86) PCT No.: PCT/JP2017/036001

§ 371 (c)(1),
(2) Date: Mar. 28, 2019

(87) PCT Pub. No.: WO2018/066565

PCT Pub. Date: Apr. 12, 2018

(65) Prior Publication Data

US 2019/0233990 A1 Aug. 1, 2019

(30) Foreign Application Priority Data

Oct. 4, 2016 (JP) ..... JP2016-196106
Jan. 30, 2017 (JP) ..... JP2017-014474

(51) Int. Cl.
*D04B 21/16* (2006.01)
*D04B 21/18* (2006.01)

(52) U.S. Cl.
CPC ..... *D04B 21/16* (2013.01); *D04B 21/18* (2013.01); *D10B 2201/01* (2013.01)

(58) Field of Classification Search
CPC ..... D04B 21/08; D04B 21/18; D04B 21/16
(Continued)

(56) References Cited

U.S. PATENT DOCUMENTS 3,910,075 A 10/1975 Holliday
4,638,648 A * 1/1987 Gajjar ..... D04B 21/18 66/193

(Continued)

FOREIGN PATENT DOCUMENTS

DE 2743822 A1 4/1979
EP 0826809 A1 3/1998

(Continued)

OTHER PUBLICATIONS

International Search Report issued in corresponding International Patent Application No. PCT/JP2017/036001 dated Dec. 5, 2017.

(Continued)

*Primary Examiner* — Danny Worrell
(74) *Attorney, Agent, or Firm* — Morgan, Lewis & Bockius LLP

(57) ABSTRACT

Provided is a warp-knitted fabric having superior stretchability and feeling of coolness when worn and that can be cut and released without cut part of the knitted fabric curling. The warp-knitted fabric is knitted using synthetic fiber derived from a first reed, cellulose fiber derived from a second reed, and elastic yarn derived from a third reed and is characterized in that the proportion of the number of crossing points where the sinker loops of the synthetic fiber going across wales present in one complete course forming the warp-knitted fabric and the sinker loops of the elastic (Continued)

yarn to the number of sinker loops for the synthetic fiber going across the wales present in the one complete course is 50% or less.

8 Claims, 5 Drawing Sheets

(58) Field of Classification Search
USPC ..... 66/192, 195
See application file for complete search history.

(56) References Cited

U.S. PATENT DOCUMENTS

| | | | | |
|---|---|---|---|---|
| 4,658,604 | A * | 4/1987 | Wilson | D04B 21/18 66/192 |
| 4,688,403 | A * | 8/1987 | Gajjar | D04B 21/18 66/195 |
| 4,802,346 | A * | 2/1989 | Gajjar | D04B 21/18 66/195 |
| 5,029,457 | A * | 7/1991 | Gajjar | D04B 21/06 66/195 |
| 9,279,201 | B2 * | 3/2016 | Akita | D04B 21/18 |
| 2006/0010930 | A1 | 1/2006 | Hardee et al. | |
| 2012/0192595 | A1 | 8/2012 | Waldman et al. | |
| 2013/0209743 | A1 | 8/2013 | Deguchi et al. | |

FOREIGN PATENT DOCUMENTS

| | | | |
|---|---|---|---|
| GB | 2005740 | A | 4/1979 |
| JP | S55-022302 | U | 2/1980 |
| JP | H09-013253 | A | 1/1997 |
| JP | 2005-054347 | A | 3/2005 |
| JP | 2007-138362 | A | 6/2007 |
| JP | 2009-209480 | A | 9/2009 |
| JP | 2010-189815 | A | 9/2010 |
| JP | 2012-188765 | A | 10/2012 |
| JP | 2013-167030 | A | 8/2013 |
| TW | 200619443 | A | 6/2006 |
| WO | 2007/052482 | A1 | 5/2007 |
| WO | 2010/089801 | A1 | 8/2010 |
| WO | 2012/049870 | A1 | 4/2012 |

OTHER PUBLICATIONS

International Preliminary Report on Patentability and Written Opinion issued in corresponding International Patent Application No. PCT/JP2017/036001 dated Apr. 9, 2019.

Supplementary European Search Report issued in corresponding European Patent Application No. 17858402.5 dated Sep. 23, 2019.

* cited by examiner

WARP-KNITTED FABRIC

FIELD

The present invention relates to a warp-knitted fabric in which cellulose fibers and an elastic yarn are interknitted and which provides an excellent cool feeling when worn in a hot environment.

BACKGROUND

Conventionally, it is known that interknitting cellulose fibers provides properties such as a cool feeling, hygroscopicity, and sweat-absorbency in garments that are in direct contact with the skin, such as undergarments and sportswear, when worn in hot conditions such as during the summer, etc. In particular, knitted fabrics which do not feel sticky, wet, or cold even during periods of sweating due to humidity or exercise as a result of specifying the content of cellulose fibers, the shape of the knitted fabric surface, etc., have been proposed. However, in recent undergarments and sportswear, knitted fabrics in which elastic yarns are interknitted to impart stretchability to the garment are used, in such fabrics knitted using elastic yarn, the thickness increases, whereby the heat dissipation tends to decrease. Further, since garments using the knitted fabric are in close contact with the body, there is a problem that such garments tend to feel sticky or wet.

In order to solve such problems, for example, Patent Literature 1 described below proposes breathable knitted fabrics in which cellulose fibers are interknitted, whereby a sticky or wet feeling due to sweating can be eliminated. However, though various techniques for round-knitting these knitted fabrics are demonstrated, since the loop structure is unique for warp knitting, the knitted fabric is particularly likely to curl, and further, garments using cut warp-knitted fabrics in which cellulose fibers are interlaced as-is have not been disclosed, and Patent Literature 1 does not disclose specific embodiments of warp-knitting in which cellulose fibers and elastic yarns are interknitted.

Thus, a stretchable warp-knitted fabric in which cellulose fibers and elastic yarn interknitted, which is excellent in cool feeling, hygroscopicity and sweat-absorbency when worn, and which can be made into garment as-cut without sewing has not been found.

CITATION LIST

Patent Literature

[PTL 1] WO 2012/049870

SUMMARY

Technical Problem

In light of the state of the art, the object of the present invention is to provide a warp-knitted fabric in which cellulose fibers and an elastic yarn are interknitted, and which has excellent stretchability, superior cool feeling when worn, and which can be cut without the occurrence of curl at the cut part of the knitted fabric. Such a tricot can be sewn into garments such as underwear and sportswear which are cool even when worn in hot conditions such as during mid-summer, and which do not feel sticky or moist even during sweating.

Solution to Problem

As a result of rigorous investigation in order to achieve the object described above, the present inventors have discovered that the above object can be achieved by a warp-knitted fabric with interknitted cellulose fibers produced with a three-guide bar tricot knitting machine in which synthetic fibers are arranged on a front guide bar, cellulose fibers are arranged on a middle guide bar, and an elastic yarn is arranged on a back guide bar, wherein the crossing points of sinker loops of the synthetic fibers and sinker loops of the elastic yarn are within a specific range, and have thus achieved the present invention.

In other words, the present invention is as described below.

[1] A warp-knitted fabric knitted with synthetic fibers derived from a first guide bar, cellulose fibers derived from a second guide bar, and an elastic yarn derived from a third guide bar, wherein the proportion of the number of crossing points, at which sinker loops of the synthetic fibers and sinker loops of the elastic yarn cross, between wales, in one complete course constituting the warp-knitted fabric, to the number of sinker loops of the synthetic fibers crossing between wales, in the one complete course is not greater than 50%.

[2] The warp-knitted fabric according to [1], wherein the knitting structure of the synthetic fibers derived from the first guide bar is a denby knitting structure or a cord knitting structure.

[3] The warp-knitted fabric according to [1] or [2], wherein one complete course of the elastic yarn derived from the third guide bar includes not less than four courses.

[4] The warp-knitted fabric according to any one of [1] to [3], wherein the knitting structures of the cellulose fibers derived from the second guide bar and the elastic yarn derived from the third guide bar are the same.

[5] The warp-knitted fabric according to [1], wherein the knitting structure of the synthetic fibers derived from the first guide bar is a four-course atlas structure.

[6] The warp-knitted fabric according to [5], wherein the knitting structure of the elastic yarn derived from the third guide bar is a denby knitting structure. [7] The warp-knitted fabric according to any one of [1] to [6], wherein either the first guide bar is a front guide bar, the second guide bar is a middle guide bar, and the third guide bar is a back guide bar, or the first guide bar is a front guide bar, the second guide bar is a back guide bar, and the third guide bar is a middle guide bar.

[8] The warp-knitted fabric according to any one of [1] to [3], [5], and [6], wherein the knitting structure of the cellulose fibers derived from the second guide bar is a knitting structure in which looping and insertion are repeated.

[9] The warp-knitted fabric according to any one of [1] and [5] to [8], wherein the runner ratio represented by the following Formula:

runner ratio=runner length of synthetic fibers derived from first guide bar/runner length of cellulose fibers derived from second guide bar is 1.7 to 3.5.

Advantageous Effects of Invention

A garment provided with the knitted fabric according to the present invention in which cellulose fibers are interknitted, which when worn even in hot conditions such as during the summer, provides a cool feeling without feeling sticky or moist even during sweating can be obtained. In particular, the knitted fabric, which is produced with a 28 to 32-gauge warp-knitting machine, can be made into garments which can be cut without the occurrence of curling in the cutting portion of the knitted fabric.

DESCRIPTION OF EMBODIMENTS

Figure 1:
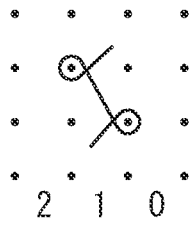
FIG. 1 is an example of a preferred organization chart of the synthetic fibers according to the present embodiment.

The embodiments of the present invention will be described in detail below.

The warp-knitted fabric of the present embodiment is knitted with synthetic fibers derived from a first guide bar, cellulose fibers derived from a second guide bar, and an elastic yarn derived from a third guide bar, wherein the proportion of the number of crossing points, at which sinker loops of the synthetic fibers and sinker loops of the elastic yarn cross, between wales, in one complete course constituting the warp-knitted fabric, to the number of sinker loops of the synthetic fibers crossing between wales present in the one complete course is not greater than 50%.

Since the warp-knitted fabric of the present embodiment has these characteristics, an excellent cooling feeling is provided thereby when worn, and thus, it can be used to produce garments which are excellent in cooling feeling when worn under hot conditions. Examples of the cellulose fibers include, for example, regenerated cellulose fibers such as rayon, cupro, and bamboo fibers and long natural cellulose fibers such as silk, though the cellulose fibers are not limited thereto, and fibers having a fiber thickness of 30 to 90 dtex (decitex; the same applies hereinafter) can be used.

Examples of the synthetic fibers include polyester fibers such as polyester and polytrimethylene terephthalate, polyamide fibers, and synthetic fibers such as polypropylene fibers, though the synthetic fibers are not limited thereto. These bright, semi-dull, or fully-dull fibers can be arbitrarily used, and the cross-section shape of the fiber may be an arbitrary cross-sectional shape such as a round shape, elliptical shape, W-shape, cocoon shape, or a hollow fiber. The form of the fiber is not particularly limited, and though a raw yarn or a crimped treated yarn such as a false-twist yarn can be used, a raw yarn, which provides an excellent cooling feeling, is preferably used. Further, a composite yarn in which two or more types of fibers are mixed by twisting, covering, or air-mixing fiber can be used. Synthetic fibers having a thickness of 20 to 110 dt can be used.

Examples of the elastic yarn include elastic yarns such as polyurethane yarns and polyether ester yarns, though the elastic yarn is not limited thereto. For example, regarding the polyurethane elastic yarn, dry spinning or melt spinning can be used, and the polymer and the spinning method are not particularly limited. The elastic yarn has an elongation at break of about 400% to 1000%, is excellent in stretchability, and the stretchability thereof is not impaired in the vicinity of the ordinary treatment temperature of 180° C. in the presetting step at the time of dyeing treatment. Furthermore, functional properties such as high setting property, antibacterial property, moisture absorption, and water-absorption can be imparted to the elastic yarn by adding special polymers and powders to the elastic yarn. The fineness of the elastic yarn is 10 to 80 dt, and preferably 15 to 60 dt whereby a knitted fabric can be easily produced using the elastic yarn.

Further, in the warp-knitted fabric of the present embodiment, inorganic substances can be included in the elastic yarns, and the knitted fabric can be used in consideration of the performance of the included inorganic substances. For example, when titanium oxide is included, the produced knitted fabric can have an excellent cool touch feeling. As the method for incorporating an inorganic substance, it is simple to incorporate the inorganic substance into the spinning stock solution of the elastic yarns prior to spinning. Examples of inorganic substances include inorganic compounds which are excellent in thermal conductivity, such as ceramics such as titanium oxide. Fine powders which do not hinder the spinning of the elastic yarn are preferred. These inorganic substances are preferably included in the elastic yarn in an amount of 1 to 10 wt %. Though the inclusion of an inorganic substance results in a knitted fabric having improved cooling properties, if the content of the inorganic substance is excessively small, the cooling effect or the like is small, and if the content of the inorganic substance is excessive, the yarn becomes likely to break upon elongation or during spinning. Thus, a content of 1 to 10 wt % is preferable, and a content of 2 to 5 wt % is more preferable.

In the present embodiment, the warp-knitted fabric is knitted using three guide bars in which two types of non-elastic c such as synthetic fibers in the first guide bar and ellulose fibers in the second guide bar are used, and an elastic yarn is used in the third guide bar. Though the knitting structure is not particularly limited and any organization of the first guide bar, second guide bar, and third guide bar can be used, it is preferable that the synthetic fibers of the first guide bar be the front guide bar, and that the knitted fabric surface has a smooth knitted structure by means of a denby knitting structure or a cord knitting structure, more preferably knitted with four-course atlas structure, which is excellent in elasticity. Furthermore, when the elastic yarn of the third guide bar is the back guide bar or the middle guide bar, and the elastic yarn of the first guide bar has a denby knitting structure or a cord knitting structure, it is preferable that a knitting structure in which one complete course includes four or more courses be used. Further, when the synthetic fibers of the first guide bar have a four-course atlas structure, a denby knitting structure is preferable.

In the warp-fabric of the present embodiment, in which elastic yarns are interknitted, the object is to provide a warp-knitted fabric which has excellent stretchability and which has an excellent cool feeling when worn, and thus, the cellulose fibers are interknitted to improve the cooling sensation and hygroscopicity. However, knitted fabrics in which cellulose fibers are interknitted are likely to curl, and thus, handling thereof is difficult, and it is impossible to use the knitted fabric as-cut. Regarding the curling, in a knitted fabric produced with a two-guide bar knitting machine using synthetic fibers and an elastic yarn, curling can be relatively easily prevented by, for example, increasing the heat setting conditions during dyeing processing. However, in three-guide bar knitting machines, the loops are complexly interknitted, and since heat-setting is ineffective for cellulose fibers, prevention of curl in three-guide bar warp-knitted fabrics, in which cellulose fibers are interknitted, has been difficult. As a result of rigorous investigation, in particular, as a result of analyzing and examining the structure of knitted fabrics in which the knitted fabric does not curl inwardly in the warp direction, which is important in garments, the present inventors have discovered that curling is likely to occur in knitted fabrics having a large amount of crossing points between the sinker loops of the synthetic fibers and the sinker loops of the elastic yarn. In other words, the present inventors have discovered that minimization of the crossing points between the sinker loops of the synthetic fibers and the sinker loops of the elastic yarn is effective in suppressing curling, and have achieved the present invention.

The reason why the crossing points between the sinker loops of the synthetic fibers and the sinker loops of the elastic yarn influences curl prevention is as described below.

When the looping state when the synthetic fibers of the first guide bar are arranged on the front guide bar, the cellulose fibers of the second guide bar are arranged on the middle guide bar, and the elastic yarn of the third guide bar is arranged on the back guide bar is observed, the elastic yarn and the synthetic fibers and cellulose fibers cross on the sinker loop surface of the knitted fabric, the sinker loops of the cellulose fibers of the middle guide bar are arranged in a curved state crossing over the sinker loops of the elastic yarn of the back guide bar, and the synthetic fibers of the front guide bar are arranged above the middle guide bar, whereby the curvature of the synthetic fibers of the front guide bar becomes larger than the curvature of the cellulose fibers of the middle guide bar. Thus, curling of the knitted fabric occurs due to the tendency of the synthetic fibers, which have a large curvature, to straighten particularly when the knitted fabric is elongated. When this knitted fabric is elongated, the curvature of the cellulose fibers tends to straighten, and since the curvature thereof is less than that of the synthetic fibers, the contribution rate to the curling of the knitted fabric is relatively small. Thus, by controlling the crossing points between the sinker loops of the synthetic fibers of the front guide bar and the sinker loops of the elastic yarn of the back guide bar, the curling of the knitted fabric can be suppressed. Furthermore, when the cellulose fibers of the second guide bar are arranged on the back guide bar and the elastic yarn of the third guide bar is arranged on the middle guide bar, curling can be prevented by controlling the crossing points between the sinker loops of the elastic yarn and the sinker loops of the synthetic fibers.

Specifically, regarding the organization constituting the knitted fabric, in one full course constituting the knitted fabric, by limiting the proportion of the number of crossing points between the sinker loops of the synthetic fibers of the first guide bar and the sinker loops of the elastic yarn of the third guide bar, which cross between the wales, to 50% or less, the occurrence of curling of the knitted fabric can be prevented. Naturally, it is preferable to limit the proportion of the number of crossing points between the sinker loops of the cellulose fibers of the second guide bar and the elastic yarn of the third guide bar to 50% or less. At least if the proportion of the crossing points between the synthetic fibers of the first guide bar and the elastic yarn of the third guide bar is limited to 50% or less, curling of the knitted fabric can be prevented. Though the lower limit of the content of the crossing points is not particularly limited, in order to maintain good dimensional stability and minimize dimensional change during washing, the proportion of the crossing points is preferably 10% or more.

When the elastic yarn includes a chain-knitting portion, such as a 10/01 organization, and the synthetic fibers have a swing organization, such as a 10/23 organization, though the sinker loops of the synthetic fibers and the sinker loops of the elastic fibers cross at a portion which is not between the wales, it has been found that crossing of the sinker loops of the chain-knitted portion of the synthetic fibers or the sinker loops of the chain-knitted portion of the elastic yarn has little influence on the curl of the knitted fabric, in particular the curl in the warp direction, and thus, it is not necessary to treat such crossing as a crossing point between the synthetic fibers and the elastic yarn. Note that the number of the crossing points between the synthetic fibers and the elastic yarn is obtained from the number of portions in which the individual sinker loops in the knitting structures shown in FIGS. 1 to 12 cross, not based on the crossing points in an actually produced knitted fabric.

Figure 2:
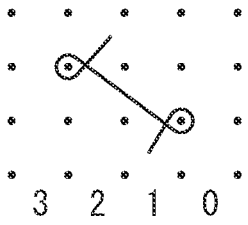
FIG. 2 is an example of a preferred organization chart of the synthetic fibers according to the present embodiment.
Figure 3:
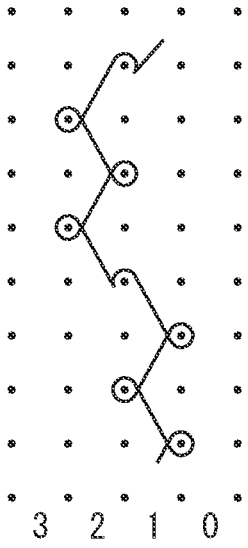
FIG. 3 is an example of a preferred organization chart of the elastic yarn according to the present embodiment.
Figure 12:
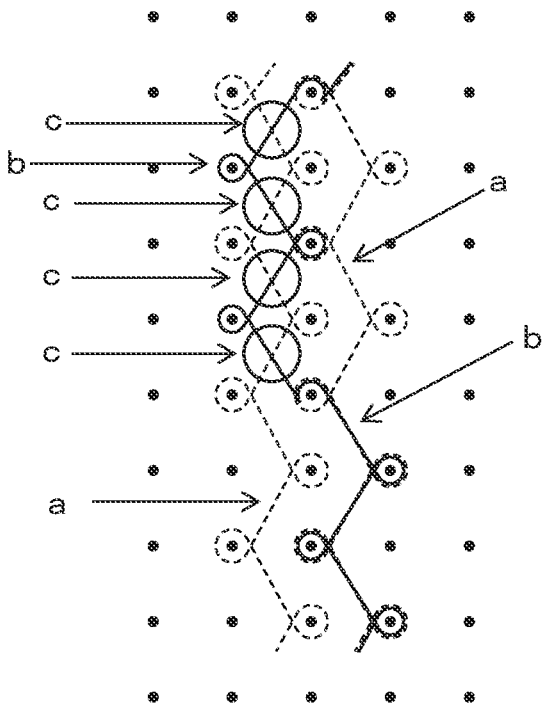
FIG. 12 is an example of crossing points of sinker loops of the synthetic fibers and elastic yarn according to the present embodiment.

One complete course in the present embodiment is composed of the number of courses necessary to knit a unit of the repeating organization. For example, when the knitted fabric has an organization in which the cord knitting structure shown in FIG. 2 is used as the first guide bar, which is the front guide bar, the denby knitting structure shown in FIG. 1 is used as the second guide bar, which is the middle guide bar, and the organization shown in FIG. 3 is used as the third guide bar, which is the back guide bar, one complete course includes two courses of the front guide bar and the middle guide bar, and one complete course includes eight courses of the back guide bar. In this case, one complete course constituting the knitted fabric includes eight courses, and by combining the front guide bar, the middle guide bar, and the back guide bar, one unit in which the organization is repeated becomes one complete course constituting the knitted fabric. Furthermore, the crossing points between the sinker loops of the synthetic fibers of the front guide bar and the elastic yarn of the back guide bar may be the points at which the synthetic fibers and the elastic yarn cross between the wales of the knitted fabric. For example, when the organization of the synthetic fibers of the front guide bar is the 10/12// organization shown in FIG. 1 and the organization of the elastic yarn of the back guide bar is the 10/12/10/12/23/21/23/21// organization shown in FIG. 3, the sinker loops of the synthetic fibers and the sinker loops of the elastic yarn are formed in eight locations in one complete course since the number of courses and the number of sinker loops is the same. Four of these sinker loops cross, and the remaining four are formed without crossing between the synthetic fibers and the elastic yarn. In this case, in the calculation of the proportion of crossing points between the front guide bar and the back guide bar in one complete course constituting a knitted fabric having eight sinker loops of synthetic fibers and eight sinker loops of elastic yarn, which cross between the wales present in one complete course, since the number of sinker loops of the synthetic fibers and the elastic yarn are the same, calculation can be performed using eight points, and the proportion of crossing points, which is calculated from the following Formula 1:

proportion of crossing points=(crossing points: four locations)/(number of sinker loops of synthetic fibers crossing between the wales present in one complete course: eight)

becomes 50%. Note that since FIG. 12 shows the crossing points of the aforementioned example, the crossing points c between the organization of the synthetic fibers a and the organization of the elastic yarn b is four locations in one complete course. Furthermore, when the number of sinker loops in one complete organization constituting the knitted fabric is different between the synthetic fibers and the elastic yarn, the proportion of the number of crossing points in one complete course to the number of crossing points of each sinker loop is obtained using the number of sinker loops of the synthetic fibers or the number of sinker loops of the elastic yarn, whichever is greater, as a baseline.

When the knitting structure is a chain-knit and the sinker loops do not cross between the wales, since these sinker loops do not count as sinker loops crossing between the wales, the crossing points thereof are not treated as crossing points of the sinker loops. For example, when the synthetic fibers of the front guide bar have the 10/23// organization shown in FIG. 1 and the elastic yarn of the back guide bar has the 10/12/21/23/21/12// organization shown in FIG. 7, there are six elastic yarn sinker loops, and four sinker loops crossing between the wales. This this case, four is used in denominator of Formula 1. Since there are no crossing points in this case, the proportion of the crossing points between the sinker loops of the front guide bar and the sinker loops crossing between the wales of the back guide bar in one complete course constituting the knitted fabric, to the sinker loops crossing between the wales of the back guide bar, is 0%.

In the warp-knitted fabric of the present embodiment, the organization of the synthetic fibers of the first guide bar is not particularly limited, and is preferably denby knitting structure or cord knitting structure zig-zag stitch having two or less needle swings. With this organization, the knitted fabric becomes smooth, and if the inner is sewn, sliding with the outer is also good, movement is easy, and it is possible to prevent the collapse of the outer, which is preferable. The denby knitting structure or the cord knitting structure can be arbitrarily selected in accordance with the basis weight and elongation of the knitted fabric to be obtained.

Further, the organization of the synthetic fibers of the first guide bar is preferably a four-course atlas structure. For example, the four-course atlas structure shown in FIG. 5, in which closed loop and open loop are combined, the four-course atlas structure shown in FIG. 6, in which only closed eyes are used, or a four-course atlas structure in which all of the eyes are open is preferable. As a result, it is possible to impart good stretchability to the knitted fabric.

In the warp-knitted fabric of the present embodiment, the organization of the elastic yarn of the third guide bar can be arbitrarily selected in balance with the organization of the synthetic fibers of the first guide bar so that the proportion of crossing points between the sinker loops of the synthetic fibers and the sinker loops of the elastic yarn is 50% or less. For example, when the synthetic fibers of the first guide bar have the denby knitting structure shown in FIG. 1, the organization of the elastic yarn of the third guide bar can be set to a swing organization such as a single-needle swing or a two-needle swing, as shown in FIGS. 3 to 8, or further any organization in which chain-knitting is combined. When the stretchability of the knitted fabric is emphasized, an organization lacking chain-knitting portions, like those shown in FIGS. 3, 5, 6, and 8, is preferable.

When the synthetic fibers of the first guide bar have a four-course atlas structure, normally, though the elastic yarn of the third guide bar is also given a four-course atlas structure, since the cellulose fibers are interknitted, the balance between the stretchability in the warp and weft directions tends to collapse, whereby the wear feeling may be poor some cases. Thus, when the synthetic fibers of the first guide bar have a four-course atlas structure, the elastic yarn of the third guide bar is given a denby knitting structure, and if stretch-balance knitting is utilized, a knitted fabric having a good balance of elasticity can be obtained, which is preferable.

Furthermore, in order to increase the cool feeling at the time of wearing and improve stretchability, when the synthetic fibers of the first guide bar have a cord knitting structure or a denby knitting structure, rather than the case in which the knit of the elastic yarn of the third guide bar is an organization in which one complete course includes two courses, such as a 10/12// denby knitting structure or a 10/23// cord knitting structure, an organization in which one complete course includes four or more courses is preferable. For example, the 10/12/23/21// organization shown in FIG. 5, more preferably the 10/12/10/23/21/23// organization shown in FIG. 8, or alternatively, an organization in which one complete course includes six or more courses, such as the 10/12/10/01/23/21/23/32// organization shown in FIG. 4. As a result, the loop balance of the cellulose fibers of the second guide bar collapses somewhat in the knitted fabric, and voids are likely to be formed between the synthetic fibers and the elastic yarn, whereby it possible to take advantage of characteristics that are superior in moisture absorption and cooling sensation of contact cooling sensation. Naturally, even if the organizations of the synthetic fibers or cellulose fibers and the elastic yarn are the same, as a result of the shrinkage of elastic yarn, voids tend to form between these fibers, whereby a warp-knitted fabric having an excellent cooling feel can be obtained.

In the warp-knitted fabric of the present embodiment, the organization of the cellulose fibers of the second guide bar can be selected from any organization, and though the organization can arbitrarily be a denby knitting structure, a cord knitting structure, or an atlas organization, an organization identical to that the of back elastic yarn is preferable. As a result, the thickness of the knitted fabric can be reduced, the feeling of cooling increases, and the occurrence of curling can be suppressed.

Figure 9:
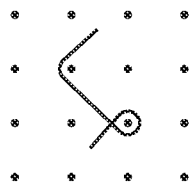
FIG. 9 is an example of a preferred organization chart of the cellulose fibers according to the present embodiment.
Figure 10:
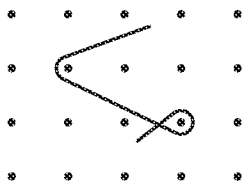
FIG. 10 is an example of a preferred organization chart of the cellulose fibers according to the present embodiment.
Figure 11:
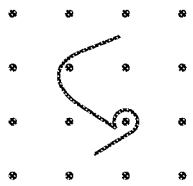
FIG. 11 is an example of a preferred organization chart of the cellulose fibers according to the present embodiment.

Further, as the organization of the cellulose fibers of the second guide bar, for example, the knitting structure is preferably the 10/22// organization shown in FIG. 9, the 10/33// organization shown in FIG. 10, or a knitting structure in which looping and insertion are repeated, such as a 10/11/12/11// organization, is preferable. An organization in which only insertion is repeated, such as a 00/22// or 00/11/22/11// organization, can be used. In this case, since the cellulose fibers become likely to break during knitting, it is preferable to use cellulose fibers having a fineness of 50 dtex or more, and it is preferable to arrange these fibers in the back guide bar. The looping organization may be an open eye organization, such as the 01/22// organization shown in FIG. 11. Naturally, when the organization timing with the synthetic fibers or the elastic yarn is arbitrary, for example, when the synthetic fibers of the first reed have a 10/23// organization and the elastic yarn of the third guide bar has a 10/12// organization, the organization of the cellulose fibers of the second reed can be an arbitrarily selected organization, such as 10/22//, 22/10//, etc.

In the warp-knitted fabric of the present embodiment, upon actual wearing, such as in an inner hem, though the knitted fabric elongates, the knitted fabric is in a state of elongation and relaxation, thus it is necessary to minimize the curling of the knitted fabric upon elongation, and it is more important that curling not occur during elongation and relaxation. However, though the rate that the cellulose fibers contribute to the curling of the knitted fabric is considerably small, since the curvature thereof is smaller than that of the synthetic fibers, when the proportion of crossing points of the sinker loops of the synthetic fibers and sinker loops of the elastic yarn is about 50%, in particular, when the cellulose fibers have a knitting structure in which looping and insertion are repeated or in which only insertion is repeated, curling may become significant upon elongation and relaxation due to instability of the organization. As a result of investigation to solve these problems, the present inventors have discovered that a length which is shorter than a runner (yarn length per 480 courses) in a normal knitted fabric is effective for suppressing curling upon elongation and relaxation. In other words, when the organization of the cellulose fibers of the second guide bar is a knitting structure in which looping and insertion are repeated or a structure in which only insertion is repeated, the organization is set such that the runner ratio, which is obtained by the following formula, of the synthetic fibers of the first guide bar to the cellulose fibers of the second guide bar is 1.7 to 3.5. In particular, when the synthetic fibers of the first guide bar have a one-needle swing organization in which all of the courses loop, such as a denby knitting structure or an atlas organization, and the cellulose fibers of the second guide bar have a knitting structure in which looping and insertion are repeated or an organization in which all of the courses are inserted, if the runner ratio is in the range of 1.7 to 3.5, the object of the present invention can be effectively achieved. Note that when the runner ratio is less than 1.7, the sinker loops of the cellulose fibers become long and the curvature of the sinker loops of the synthetic fibers becomes larger, whereby curling is more likely to occur, and when the runner ratio is greater than 3.5, breakage of the cellulose fibers occurs, whereby knitting is impossible. Thus, as long as the runner ratio of the synthetic fibers of the first guide bar to the cellulose fibers of the second guide bar is in the range of 1.7 to 3.5, preferably 1.9 to 3.2, curling of the knitted fabric during elongation and relaxation is unlikely to occur.

$$\text{runner ratio} = \text{runner length of synthetic fibers} / \text{runner length of cellulose fibers} \quad (1)$$

Furthermore, the loop structure of the knitting structure of the warp-knitted fabric of the present invention is arbitrary, and can be selected from an open eye organization, closed eye organization, or an organization in which closed eyes and open eyes are combined. The organization of the synthetic fibers of the front reed is preferable an open eye denby knitting structure or an open eye cord knitting structure, and the organization of the cellulose fibers of the middle reed is preferable a closed eye loop structure.

Regarding the loop structure, the positional relationship between the cellulose fibers of the second guide bar, which are two non-elastic yarns, and the synthetic fiber of the first guide bar in the knitted fabric is important. Normally, in the case in which the cellulose fibers are interknitted, when the cellulose fibers are exposed on the surface knitted fabric, excellent cold touch feeling and sweat-absorbency can be obtained. However, practical problems such as the deterioration of the cellulose fibers due to the dyeing process, as a result of being worn as a garment, or due washing, and a decrease in frictional colorfastness in dark colors, resulting in a risk of color transfer to adjacent garments, are likely to occur. If the exposure of the cellulose fibers on the surface of the knitted fabric is minimized to the greatest extent possible, the likelihood of occurrence of these problems can be minimized. Thus, the positional relationship of the cellulose fibers can be adjusted by positioning the synthetic fibers of the first guide bar more toward the front side than the cellulose fibers of the second guide bar and selecting the loop structure. In the present embodiment, when the first guide bar is the front guide bar and the second guide bar is the middle guide bar, the synthetic fibers of the front guide bar have an open eye loop structure, the organization of the cellulose fibers of the middle guide bar is a fully-open eye organization or an atlas organization, such as a 10/12/23/21// organization, if the organization in which the eyes close when the reed swings, a knitted fabric in which the occurrence of curling is minimized, the exposure of the cellulose fibers on the surface is minimized, the wet coefficient of friction is not reduced, and which provides a cool feeling can be obtained.

Regarding the cold touch feeling of the warp-knitted fabric of the present embodiment, a knitted fabric exhibiting a cold touch feeling of 120 $W/m^{2\circ}$ C. in the cold touch feeling measurement specifically shown in the Examples and which feels cool in the subjective wearing evaluation is considered to have a cold touch feeling.

In the present embodiment, in order to obtain a knitted fabric achieving a cold touch, the basis weight of the knitted fabric and the mixing ratio of the cellulose fibers is important. By setting these values within an appropriate range, the desired effect can be more easily achieved.

In the present embodiment, it is preferable that the basis weight of the knitted fabric be in the range of 150 to 250 $g/m^2$ and the mixing ratio of the cellulose fibers be in the range of 15 to 45%. If the basis weight of the knitted fabric is excessively high, the heat dissipation of the knitted fabric is reduced, whereby a cold touch cannot be obtained. When the basis weight is excessively low, the tensile strength of the knitted fabric decreases, which causes problems during actual wearing. Thus, the basis weight of the knitted fabric is preferably in the range of 150 to 250 $g/m^2$, more preferably 160 to 240 $g/m^2$. Furthermore, regarding the mixing ratio of the cellulose fibers, when the mixing ratio of the cellulose fibers is excessively high, though the cold touch feeling tends to improve, practical problems such as wet frictional colorfastness tend to occur, and when the mixing ratio of the cellulose fibers is excessively low, the cold touch feeling is reduced. Thus, design of the knitted fabric with regards to the fineness of the cellulose fibers, the fineness of the synthetic fibers, and the fineness of the elastic yarn can be performed such that the mixing ratio of the cellulose fibers is preferably 15 to 45%, more preferably 20 to 40%. Note that though measurement of the mixing ratio of the cellulose fibers can be obtained by calculating when the numerical values of the fineness and runner length of each fiber are known, when the fineness and the runner length of each fiber is unclear, the mixing ratio can be obtained by a method of removing the fibers other than cellulose fibers by dissolution, or a method in which the basis weight of the non-elastic yarn is obtained by measuring the weight (basis weight) of the cut knitted fabric, thereafter dissolving the elastic yarn, measuring the weight of the knitted fabric, calculating the basis weight of only the elastic yarn, and subtracting the basis weight of the elastic yarn from the basis weight of the knitted fabric, and thereafter, measuring the runner length and fineness of the cellulose fibers, and calculating the basis weight and mixing ratio of only the cellulose fibers relative to the synthetic fibers.

In addition to being superior in cool feeling such as cold touch feeling, heat dissipation, and breathability as a knitted fabric, it is necessary that the warp-knitted fabric of the present embodiment have excellent cool feeling as a garment. In a knitted fabric in which cellulose fibers are interlaced, it is possible to increase the cold touch feeling by closely contacting the cellulose fibers to the skin to utilize the cold touch feeling of the cellulose fibers. Since garments made of a knitted fabric having elastic yarns which are not interlaced do not closely contact the body, the feeling of coldness when the garment is worn can be observed only in the part in which the skin and the garment in contact each other. In knitted fabrics in which the elastic yarns are interknitted, the entire garment closely contacts the body, whereby an overall cool feeling can be easily observed. However, when the elongation of the knitted fabric is low, it becomes difficult to move while wearing the garment, which is uncomfortable. Conversely, when the elongation of the knitted fabric is too high, a cold touch feeling cannot be obtained. Thus, the elongation of the knitted fabric should be within an appropriate range. The knitted fabric can be finished by designing the knitted fabric and adjusting the elongation during the dyeing process such that the elongation of the knitted fabric, specifically under a load of 9.8 N (Newtons) in both the warp direction of the knitted fabric and the weft direction of the knitted fabric, is preferably 80 to 150%, more preferably 90 to 140%.

Though the warp-knitted fabric of the present embodiment is a knitted fabric which is excellent in cool feeling even under hot conditions, when the angle of a line drawn in the length direction of the knitted fabric is 90 degrees relative to a straight line drawn in the width direction of the knitted fabric (baseline: 0 degrees), since curling is unlikely to occur at the cutting edge, even if cutting is arbitrarily performed, such as along a straight line or a curved line between 45 and 135 degrees when producing a garment, the knitted fabric can be made into a garment in an as-cut state without the need to clean up the edges by means of triple-fold sewing, piping stitching, etc. Normally, when producing a knitted fabric which can be used as-cut, in interknitted knitted fabrics composed of synthetic fibers and an elastic yarn, in which heat setting of the polyester or nylon is easy, it is possible to reduce the occurrence of curling of the knitted fabric by heat setting of the synthetic fibers by imposing strict heat setting conditions, such as raising the temperature or lengthening the setting time during the heat setting of the dyeing process, and all known cutable garments are produced using this technology. However, in the case of cellulose fibers, for which heat-setting is difficult, since the occurrence of curling cannot be prevented by imposing strict heat setting conditions at the time of dyeing, though it was considered that cutting of knitted fabrics in which cellulose fibers were interknitted, in particular in the form of a warp-knitted fabric, was impossible, in the warp-knitted fabric of the present embodiment, since curling does not occur at the cutting edge even though cellulose fibers, for which heat setting is difficult, are interlaced therein, the knitted fabric can be cut to produce products.

In the present embodiment, by setting the organizations and loop structures of the cellulose fibers, which are difficult to heat set, and synthetic fibers, for which heat setting is easy, to specific ranges, a knitted fabric that can be cut without occurrence of curling at the cutting part and which is excellent in cold touch feeling can be obtained.

The warp-knitted fabric of the present embodiment can be manufactured by a tricot or Russell warp knitting machine, and can be manufactured by a single warp knitting machines of these types. Regarding the gauge of the knitting machine, though an arbitrary gauge knitting machine can be used, it is preferable to use a 20 to 40-gauge knitting machine. If the gauge is coarse, the aesthetic property of the knitted fabric is poor, and the density of the knitted fabric increases when the gauge of the knitting machine becomes a gauge higher than 40-gauge. Furthermore, since stretchability becomes poor, the effect of the present invention is less exhibited. If the gauge of the knitting machine is coarse, a fraying of the cutting edge occurs. Thus, in order to produce a knitted fabric that can be cut, it is preferable to use a 28 to 32-gauge warp knitting machine.

Further, as the threading of the guide bars of the non-elastic yarn and the elastic yarn, rather than only an all-in method in which all of the guide bars are threaded, arbitrary threading can be used, such as one-in-one-out in which a threading in which one yarn is passed through a guide bar and one yarn is not passed through the guide bar is repeated, two-in-one-out, in which a threading in which two yarns are passed in succession through a guide bar and one yarn is not passed through the guide bar is repeated.

Conventional dyeing and finishing processes can be used as the methods for dyeing and finishing the warp-knitted fabric of the present embodiment. The dyeing conditions are set in accordance with the fiber material used. An arbitrary dyeing machine such as a liquid dyeing machine, a wince dyeing machine, or a paddle dyeing machine can be used. Furthermore, a processing agent which improves water absorption and flexibility can be used.

EXAMPLES

The present invention will be specifically described below by way of the Examples. Naturally, the present invention is not limited to these Examples. Evaluation of the Examples was carried out by the following methods. In the following Examples 1 to 8, the first reed synthetic fibers are examples of zigzag knitting with a two-needle swing or less, and Examples 9 and 10 are examples of stretch balancing knitting.

(1) Cool Feeling Sensation

The maximum heat transfer amount ($W/m^2 \cdot {}^\circ C.$) of the sinker loop side of a knitted fabric cut to 8 cm×8 cm is measured in an environment of 20° C. and 65% RH using a KES-F7-11 manufactured by KatoTech, Co., wherein the sinker loop side of the knitted fabric is placed on the heated plate of the device, which has been heated to 10° C. above ambient temperature.

(2) Sinker Loop Crossing Points

The organization of the first guide bar synthetic fibers and the organization of the third guide bar elastic yarn are drawn as organization charts. Thereafter, the organization charts are superimposed and the crossing points between the sinker loops of the synthetic fibers and the sinker loops of the elastic yarn are identified.

(3) As-Cut Characteristics

Evaluation of the as-cut characteristics of the knitted fabric with regards to curl is evaluated. Sampling and evaluation are performed by the following method.

Figure 13:
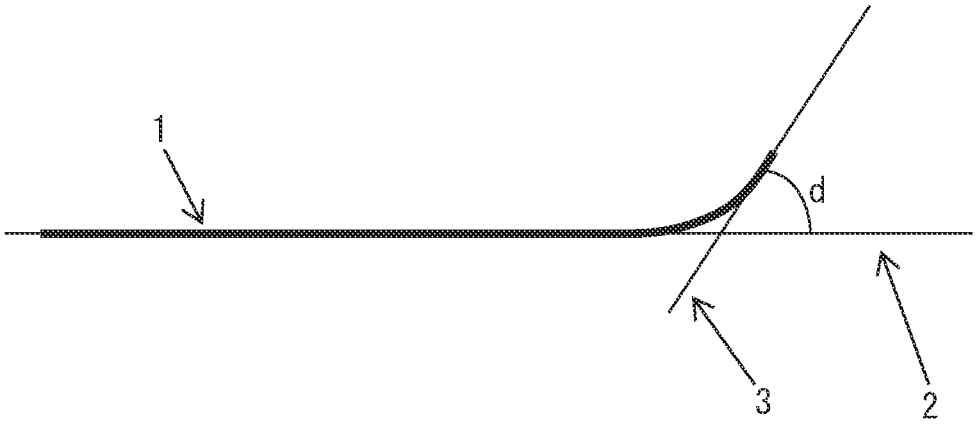
FIG. 13 is an explanatory view of a method of measuring the curl of the knitted fabric according to the present embodiment.

A knitted fabric is cut at a length of 20 cm in the warp direction along the wale of the knitted fabric and cut at a length of 20 cm in the width direction, and the cut sample is placed on a horizontal workstation as a knitted fabric measuring 20 cm×20 cm. Thereafter, both ends in the warp direction are grasped with fingers and stretched by 80%, and the angle of the curl occurring in the warp direction at that time as shown in FIG. 13, i.e., the curl angle (d) between the straight line (2) in contact with the horizontal knitted fabric (1) and the straight line (3) in contact with the end portion of the elongated knitted fabric is measured, and the curling property is evaluated according to the following criteria:

Excellent: the curl angle is 30 degrees or less; there are no problem when used as a cut product Good: the curl angle is between 30 degrees and 60 degrees; can be used as a cut product Fair: the curl angle is in the range of greater than 60 degrees to 90 degrees; difficult to use as a cut product Poor: the curl angle is greater than 90 degrees; cannot be used as a cut product In the above criteria, "Excellent" and "Good" indicate a knitted fabric having little curling at the cut portion, and such knitted fabrics can be used as a cut product.

(4) Stretch Relaxation Curl

The knitted fabric evaluated in (3) above is elongated 80% in the warp direction, immediately relaxed and placed on a horizontal workstation, and the curling angle after 5 minutes is measured and evaluated by the method of (3).

If the elongation relaxation curl is 60 degrees or less, the knitted fabric is particularly excellent in as-cut characteristics.

(5) Runner Ratio

A synthetic fiber and cellulose fiber in the knitted fabric are extracted at the same course length, and the lengths thereof are measured by applying a load of 0.1 g to each fiber. The runner ratio is obtained by the Formula (1), rounding off the second digit of the decimal point.

Regarding the method for extracting the fibers from the knitted fabric, a method of releasing the loops constituting the knitted fabric by cutting or the like, for example, a method of cutting the loops of the cellulose fibers and the elastic yarns to leave only synthetic fibers when extracting the synthetic fibers, or another method in which the elastic yarn is removed from the knitted fabric by dissolution (including degradation by embrittlement), next, the cellulose fibers are dissolved, and the runner length of the synthetic fibers are measured, and from a separately prepared knitted fabric, the elastic yarn and synthetic fibers are removed by dissolution or the like, and the runner length of only the cellulose fibers are obtained, whereby the runner ratio is obtained, or alternately, a method in which loop extraction and dissolution are combined may be used.

runner ratio=runner length of synthetic fibers derived from first guide bar/runner length of cellulose fibers derived from second guide bar (1)

(6) Dimension Change after Washing

A washing-drying test of the obtained knitted fabric is carried out by the C4M method described in JIS L 1930 (2014), and the rate of change in dimension before and after washing is measured. A positive dimensional change rate indicates that the washing caused shrinkage. The evaluation criteria for the dimensional change after washing are as follows.

Good: dimensional change rate is 0 to 1.5%

Fair: dimensional change rate is 1.5 to 3.0%

Poor: dimensional change rate exceeds 3.0%

If the dimensional change rate is 3.0% or less, manufacturing processability is good, but depending on the item to be sewn, care must be taken with regards to edge treatment. If the dimensional change rate is 1.5% or less, such problems do not occur, and the knitted fabric is a particularly good fabric.

Example 1

Knitting was performed using a 28-gauge tricot warp-knitting machine in which a 33 dt/24 filament nylon was arranged on the front guide bar, a 33 dt/24 filament cupro (product name: Bemberg; manufactured by Asahi Kasei Corp.) was arranged on the middle guide bar, and a 44 dt elastic yarn (product name: Roica CR, manufactured by Asahi Kasei Corp.) was arranged on the back guide bar at 100% warp elongation, wherein all three yarns were threaded through the guide bars, and the front guide bar utilized the cord knitting structure shown in FIG. 2, the middle guide bar utilized the denby knitting structure shown in FIG. 1, and the back guide bar utilized the organization shown in FIG. 8.

front guide bar: organization 10/23// middle guide bar: organization 10/12// back guide bar: organization 10/12/10/23/21/23//

The produced knitted fabric was relaxed and refined with a continuous refining machine, and thereafter, presetting was performed at 190° C. for 1 minute, and the nylon and cellulose fibers were dyed with a liquid dyeing machine. After dyeing, a fabric softener was applied to the knitted fabric, and finish setting was performed at 170° C. for 1 minute to obtain a warp-knitted fabric. The content of the cellulose fibers in the knitted fabric was 34%, and the performance of the obtained knitted fabric was evaluated. The results are shown in Table 1 below. The obtained warp-knitted fabric had no problems in cutability without the occurrence of curling at the cutting part of the knitted fabric, and was excellent in texture, elongation, wearing texture, and sewing processability.

Examples 2 to 5 and Comparative Example 1

Figure 4:
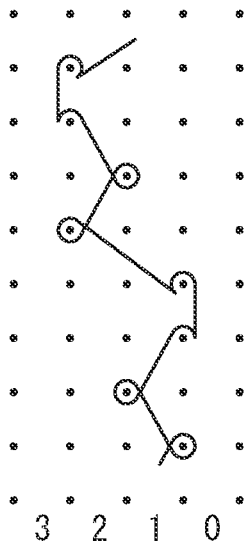
FIG. 4 is an example of a preferred organization chart of the elastic yarn according to the present embodiment.
Figure 5:
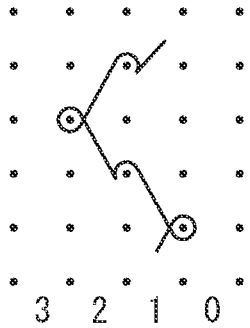
FIG. 5 is an example of a preferred organization chart of the elastic yarn according to the present embodiment.
Figure 6:
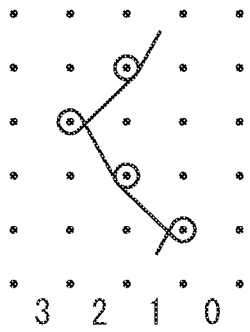
FIG. 6 is an example of a preferred organization chart of the elastic yarn according to the present embodiment.
Figure 7:
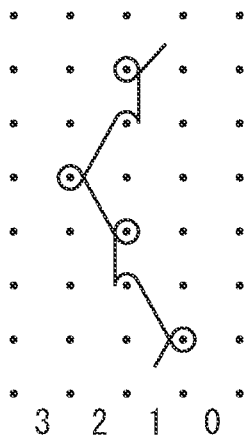
FIG. 7 is an example of a preferred organization chart of the elastic yarn according to the present embodiment.
Figure 8:
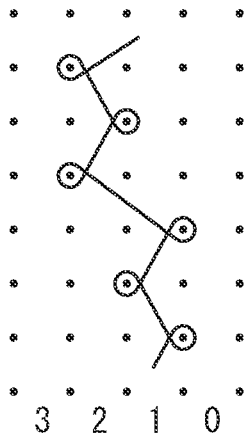
FIG. 8 is an example of a preferred organization chart of the elastic yarn according to the present embodiment.

Knitted fabrics were produced in the same manner as Example 1 except that the organization of the elastic yarn of the back guide bar was changed, and the crossing points of the sinker loops of the synthetic fibers and the sinker loops of the elastic yarn were changed (Example 2, FIG. 4; Example 3, FIG. 5; Example 4, FIG. 6; and Example 5, FIG. 7) and a knitted fabric was produced in the same manner as Example 1 except that the organization of the back guide bar was changed to 12/10// (Comparative Example 1). The performances of the obtained knitted fabrics were evaluated. The results are shown in Table 1 below.

The warp-knitted fabrics obtained in Examples 2 to 5 could be made into a cut product without the occurrence of curling at the cut part of the knitted fabric, and were excellent in texture, elongation, wearing texture, and sewing processability.

Example 6

Knitting was performed using a 32-gauge tricot warp-knitting machine in which a 22 dt/6 filament polyester was arranged on the front guide bar, a 33 dt/24 filament cupro (product name: Bemberg; manufactured by Asahi Kasei Corp.) was arranged on the middle guide bar, and a 22 dt elastic yarn (product name: Roica SF, manufactured by Asahi Kasei Corp.) was arranged on the back guide bar at 100% warp elongation, wherein the front guide bar had a 01/21// organization and the middle guide bar and back guide bar had the organization shown in FIG. 33 front guide bar: organization 10/21// middle guide bar: organization 10/12/10/12/23/21/23/21// back guide bar: organization 10/12/10/12/23/21/23/21//

The produced knitted fabric was relaxed and refined with a continuous refining machine, and thereafter, presetting was performed at 190° C. for 1 minute, and the nylon and cupro were dyed with a liquid dyeing machine. After dyeing, a fabric softener was applied to the knitted fabric, and finish setting was performed at 170° C. for 1 minute to obtain a warp-knitted fabric.

The performance of the obtained knitted fabric was evaluated. The results are shown in Table 1 below. The obtained warp-knitted fabric could be made into a product by cutting, and was excellent in texture, elongation, wearing texture, and sewing processability.

Example 7

Knitting was performed using a 28-gauge tricot warp-knitting machine in which a 78 dt/24 filament nylon was arranged on the front guide bar, a 56 dt/30 filament cupro (product name: Bemberg; manufactured by Asahi Kasei Corp.) was arranged on the middle guide bar, and a 44 dt elastic yarn (product name: Roica SF, manufactured by Asahi Kasei Corp.) was arranged on the back guide bar at 100% warp elongation, wherein the front guide bar had a 01/32// organization and the middle guide bar and back guide bar had the organization shown in FIG. 6.

front guide bar: organization 10/32// middle guide bar: organization 10/21/23/21// back guide bar: organization 10/21/23/21//

The produced knitted fabric was relaxed and refined with a continuous refining machine, and thereafter, presetting was performed at 190° C. for 1 minute, and the nylon and cupro were dyed with a liquid dyeing machine. After dyeing, a fabric softener was applied to the knitted fabric, and finish setting was performed at 170° C. for 1 minute to obtain a warp-knitted fabric.

The performance of the obtained knitted fabric was evaluated. The results are shown in Table 1 below. The obtained warp-knitted fabric could be made into a product by cutting, and was excellent in texture, elongation, wearing texture, and sewing processability.

Example 8

Knitting was performed using a 28-gauge tricot warp-knitting machine in which a 33 dt/24 filament nylon was arranged on the front guide bar, a 33 dt/24 filament cupro (product name: Bemberg; manufactured by Asahi Kasei Corp.) was arranged on the middle guide bar, and a 33 dt elastic yarn (product name: Roica SF, manufactured by Asahi Kasei Corp.) was arranged on the back guide bar at 100% warp elongation. The organizations were as follows.

front guide bar: organization 10/23// middle guide bar: organization 12/11/10/11// back guide bar: organization 10/12//

The produced knitted fabric was relaxed and refined with a continuous refining machine, and thereafter, presetting was performed at 190° C. for 1 minute, and the nylon and cupro were dyed with a liquid dyeing machine. After dyeing, a fabric softener was applied to the knitted fabric, and finish setting was performed at 170° C. for 1 minute to obtain a warp-knitted fabric.

The performance of the obtained knitted fabric was evaluated. The results are shown in Table 1 below. The obtained warp-knitted fabric could be made into a product by cutting, and was excellent in texture, elongation, wearing texture, and sewing processability.

Example 9

Knitting was performed using a 28-gauge tricot warp-knitting machine in which a 33 dt/24 filament nylon was arranged on the front guide bar, a 33 dt/24 filament cupro (product name: Bemberg; manufactured by Asahi Kasei Corp.) was arranged on the middle guide bar, and a 44 dt elastic yarn (product name: Roica CR, manufactured by Asahi Kasei Corp.) was arranged on the back guide bar at 100% warp elongation, wherein all three yarns were threaded through the guide bars. The organizations were as follows.

front guide bar: organization 10/21/23/12// middle guide bar: organization 10/11/12/11// back guide bar: organization 10/12//

The produced knitted fabric was relaxed and refined with a continuous refining machine, and thereafter, presetting was performed at 190° C. for 1 minute, and the nylon and cellulose fibers were dyed with a liquid dyeing machine. After dyeing, a fabric softener was applied to the knitted fabric, and finish setting was performed at 170° C. for 1 minute to obtain a warp-knitted fabric. The content of cellulose fibers in this knitted fabric was 34%. The performance of the obtained knitted fabric was evaluated. The results are shown in Table 1 below. The obtained warp-knitted fabric had no problems in cutability without the occurrence of curling at the cutting part of the knitted fabric, and was excellent in texture, elongation, wearing texture, and sewing processability.

Examples 11 to 13

A knitted fabric was produced in the same manner as Example 9 except that the runner length of the cellulose fibers was shortened (Example 11), and knitted fabrics were produced in the same manner as Example 9 except that the runner length of the cellulose fibers was lengthened (Examples 12 and 13). The performances of the obtained knitted fabrics were evaluated. The results are shown in Table 1 below.

Example 10

Knitting was performed using a 28-gauge tricot warp-knitting machine in which a 33 dt/24 filament nylon was arranged on the front guide bar, a 78 dt elastic yarn (product name:

Roica CR, manufactured by Asahi Kasei Corp.) was arranged on the middle guide bar at 100% warp elongation, and a 84 dt/56 filament cupro (product name: Bemberg; manufactured by Asahi Kasei Corp.) was arranged on the back guide bar, wherein all three yarns were threaded through the reeds. The organizations were as follows.

front guide bar: organization 10/21/23/12// middle guide bar: organization 10/12// back guide bar: organization 00/22/33/11//

The produced knitted fabric was relaxed and refined with a continuous refining machine, and thereafter, presetting was performed at 190° C. for 1 minute, and the nylon and cellulose fibers were dyed with a liquid dyeing machine. After dyeing, a fabric softener was applied to the knitted fabric, and finish setting was performed at 170° C. for 1 minute to obtain a warp-knitted fabric. The content of cellulose fibers in this knitted fabric was 34%. The performance of the obtained knitted fabric was evaluated. The results are shown in Table 1 below. The obtained warp-knitted fabric had no problems in cutability without the occurrence of curling at the cutting part of the knitted fabric, and was excellent in texture, elongation, wearing texture, and sewing processability.

Comparative Example 2

Knitting was performed using a 28-gauge tricot warp-knitting machine in which a 33 dt/24 filament nylon was arranged on the front guide bar, a 33 dt/24 filament cupro (product name: Bemberg; manufactured by Asahi Kasei Corp.) was arranged on the middle guide bar, and a 33 dt elastic yarn (product name: Roica SF, manufactured by Asahi Kasei Corp.) was arranged on the back guide bar at 100% warp elongation. The organizations were as follows.

front guide bar: organization 10/23// middle guide bar: organization 12/10/12/10/12/21/10/01// back guide bar: organization 12/10/12/10/12/21/10/01//

The produced knitted fabric was relaxed and refined with a continuous refining machine, and thereafter, presetting was performed at 190° C. for 1 minute, and the nylon and cupro were dyed with a liquid dyeing machine. After dyeing, a fabric softener was applied to the knitted fabric, and finish setting was performed at 170° C. for 1 minute to obtain a warp-knitted fabric.

The performance of the obtained knitted fabric was evaluated. The results are shown in Table 1 below. The obtained warp-knitted fabric had excessive crossing points between the synthetic fibers and the elastic yarns, and it was impossible to produce a product by cutting.

TABLE 1

| | Basis Weight ($g/m^2$) | Mixing Ratio of Cellulose Fibers (%) | Cold Touch Feeling ($W/m^{2\circ}$ C.) | Proportion of Crossing Points of Sinker Loops (%) | As-Cut Characteristics | Elongation and Relaxation Curl | Runner Ratio | Dimensional Change Rate After Washing Warp | Dimensional Change Rate After Washing Weft |
|---|---|---|---|---|---|---|---|---|---|
| Example 1 | 196 | 34 | 159 | 0 | Excellent | 15 | 1.4 | Fair | Fair |
| Example 2 | 184 | 35 | 159 | 37.5 | Excellent | 28 | 1.4 | Good | Good |
| Example 3 | 192 | 33 | 155 | 50 | Good | 41 | 1.4 | Good | Good |
| Example 4 | 192 | 33 | 154 | 50 | Good | 44 | 1.4 | Good | Good |
| Example 5 | 175 | 33 | 151 | 0 | Excellent | 19 | 1.4 | Fair | Fair |
| Example 6 | 162 | 41 | 188 | 50 | Good | 49 | 1.1 | Good | Good |
| Example 7 | 240 | 25 | 137 | 0 | Excellent | 21 | 1.5 | Fair | Fair |
| Example 8 | 168 | 21 | 131 | 0 | Excellent | 15 | 2.3 | Fair | Fair |
| Example 9 | 156 | 22 | 167 | 50 | Excellent | 15 | 2.7 | Good | Good |
| Example 10 | 178 | 34 | 171 | 50 | Excellent | 30 | 3.2 | Good | Good |
| Example 11 | 148 | 20 | 179 | 50 | Excellent | 30 | 3.1 | Good | Good |
| Example 12 | 167 | 25 | 156 | 50 | Good | 35 | 1.9 | Good | Good |
| Example 13 | 177 | 30 | 162 | 50 | Good | 54 | 1.6 | Good | Good |
| Comp. Ex. 1 | 191 | 35 | 157 | 100 | Poor | 105 | 1.4 | Poor | Poor |
| Comp. Ex. 2 | 189 | 30 | 119 | 62.5 | Fair | 95 | 1.4 | Poor | Poor |

INDUSTRIAL APPLICABILITY

The warp-knitted fabric of the present invention provides excellent stretchability and cool feeling when worn, and can be made into a product while being cut without the occurrence of curling of the cutting portion of the knitted fabric, and is thus optimal as the material of a sports undergarment. Since the warp-knitted fabric of the present invention is excellent in cool feeling when worn, it can be used for garment products that can be expected to have a cooling function of the body without feeling sticky or moist even when sweating in hot conditions such as during the summer.

REFERENCE SIGNS LIST

1 horizontal knitted fabric on a workstation
2 straight line coaxial with horizontal knitted fabric
3 straight line coaxial with edge of horizontal knitted fabric in which curl was generated
a synthetic fibers organization (dotted line)
b elastic yarn organization (solid line)
c crossing point between synthetic fibers and elastic yarn
d curl angle

The invention claimed is:

1. A warp-knitted fabric with sinker loops, which is knitted by a three-guide bar warp knitting machine in which synthetic fibers obtained from a first guide bar, cellulose fibers obtained from a second guide bar, and an elastic yarn obtained from a third guide bar are used, wherein the proportion of the number of crossing points, at which sinker loops of the synthetic fibers and sinker loops of the elastic yarn cross, between wales, in one complete course constituting the warp-knitted fabric, to the number of sinker loops of the synthetic fibers crossing between wales, in the one complete course, is not greater than 50% and the knitting structure of the cellulose fibers obtained from the second guide bar is a knitting structure in which looping and insertion are repeated.

2. The warp-knitted fabric according to claim 1, wherein the knitting structure of the synthetic fibers obtained from the first guide bar is a denbigh knitting structure or a cord knitting structure.

3. The warp-knitted fabric according to claim 1, wherein one complete course of the elastic yarn obtained from the third guide bar includes not less than four courses.

4. The warp-knitted fabric according to claim 1, wherein the knitting structures of the cellulose fibers obtained from the second guide bar and the elastic yarn obtained from the third guide bar are the same.

5. The warp-knitted fabric according to claim 1, wherein the knitting structure of the synthetic fibers obtained from the first guide bar is a four-course atlas structure.

6. The warp-knitted fabric according to claim 5, wherein the knitting structure of the elastic yarn obtained from the third guide bar is a denbigh knitting structure.

7. The warp-knitted fabric according to claim 1, wherein either the first guide bar is a front guide bar, the second guide bar is a middle guide bar, and the third guide bar is a back guide bar, or the first guide bar is a front guide bar, the second guide bar is a back guide bar, and the third guide bar is a middle guide bar.

8. The warp-knitted fabric according to claim 1, wherein the runner ratio represented by the following Formula:

runner ratio=runner length of synthetic fibers obtained from first guide bar/runner length of cellulose fibers obtained from second guide bar is 1.7 to 3.5.

* * * * *